US005799980A

United States Patent [19]

McAdam

[11] Patent Number: 5,799,980

[45] Date of Patent: Sep. 1, 1998

[54] POSABLE BOOK

[75] Inventor: Christine A. McAdam, Redondo Beach, Calif.

[73] Assignee: Indigo Corporation, Bellevue, Wash.

[21] Appl. No.: 823,886

[22] Filed: Mar. 17, 1997

[51] Int. Cl.[6] ..... B42D 3/00

[52] U.S. Cl. ..... 281/29; 281/15.1; 281/37; 281/51

[58] Field of Search ..... 281/29, 15.1, 37, 281/51

[56] References Cited

U.S. PATENT DOCUMENTS

| | | | |
|---|---|---|---|
| D. 358,605 | 5/1995 | Weems | D19/29 |
| D. 367,888 | 3/1996 | Lai | D19/59 |
| 1,728,431 | 9/1929 | Mevi | 281/51 |
| 2,113,099 | 4/1938 | Sloan | 281/29 |
| 3,135,532 | 6/1964 | Rankin et al. | 281/33 |
| 4,306,737 | 12/1981 | Errichiello | 281/32 |
| 4,576,497 | 3/1986 | Beleckis | 402/73 |
| 4,597,743 | 7/1986 | Becker et al. | 281/15.1 |
| 4,741,655 | 5/1988 | James | 281/29 |
| 4,832,648 | 5/1989 | Theobald et al. | 446/72 |
| 4,850,924 | 7/1989 | Becker et al. | 281/15.1 |
| 4,909,542 | 3/1990 | Marks | 281/15.1 |
| 5,059,149 | 10/1991 | Stone | 446/73 |
| 5,383,684 | 1/1995 | Smath | 281/29 |
| 5,472,364 | 12/1995 | Castleman | 446/71 |
| 5,681,199 | 10/1997 | Morris | 281/15.1 |

*Primary Examiner*—Daniel W. Howell
*Assistant Examiner*—Adesh Bhargava
*Attorney, Agent, or Firm*—Seed and Berry LLP

[57] ABSTRACT

A bound assembly with posable projections projecting outwardly from a cover of the assembly for supporting the assembly in a selected position or for pointing to selected pages within the assembly. The projections include coverings shaped to resemble hands, feet, heads, or other appendages of people or animals to make the assemblies more attractive to youthful readers.

28 Claims, 3 Drawing Sheets

POSABLE BOOK

TECHNICAL FIELD

The present invention is directed toward a bound assembly, and more particularly, toward a bound assembly with a cover and pages.

BACKGROUND OF THE INVENTION

Books, primarily children's books, are often provided with decorative and colorful covers for aesthetic purposes. The decorative colors are contained within the confines of the cover of the book, and are pleasing to youthful book readers. Such attractive book covers make the books more appealing to the youthful readers.

SUMMARY OF THE INVENTION

The present invention provides a bound assembly book that has a cover and movable projections extending from the cover. The projections are clad with decorative or fanciful coverings to increase the appeal of the assembly to its users. The projections are movable relative to the cover to orient the bound assembly in a selected position relative to a surface on which the assembly rests, or to point to selected portions of the assembly.

In one embodiment of the present invention, the bound assembly is a book that includes a first cover and a second cover attached to the first cover with a binding. The second cover is movable relative to the first cover, and a plurality of pages are attached to the binding and positioned between the first and second covers. A frame is attached to the first cover and has a plurality of projecting portions extending outwardly from at least one edge of the first cover. The projecting portions are movable to selected positions relative to the first cover.

In a preferred embodiment, the projecting portions have flexible coverings shaped to represent human or animal limbs, for instance, legs and feet, or hands and arms. Projecting portions representing legs and feet may be bent so as to "sit" or stand the book on a surface. Projecting portions representing arms and hands may be bent so as to point to a selected page.

These and other aspects of this invention will become evident upon reference to the following detailed description and attached drawings.

DETAILED DESCRIPTION OF THE INVENTION

Figure 1:
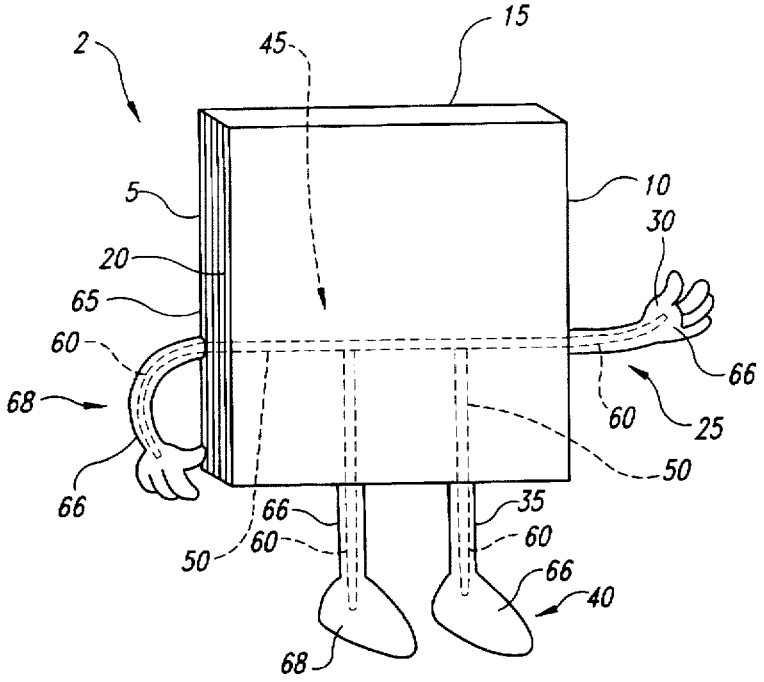
FIG. 1 is an isometric view of a representative book in accordance with the present invention having a frame which is shown in hidden lines and which projects from a rear cover of the book, the frame having flexible coverings in the form of posable legs and arms, the book being shown upright and standing on the movable legs.

A bound assembly 1, in accordance with the present invention is shown in the drawings for illustrative purposes. As seen in FIG. 1, the bound assembly 1 illustrated is a book 2 that includes a rear cover 5 attached to a front cover 10 with a top edge binding 15. Pages 20 are attached to a binding 15 between the front cover 10 and rear cover 5. The rear cover 5 has a frame 45 partially contained therein. The frame 45 has internal portions 50 which are contained within the confines of the four edges 65 of the rear cover 5. The frame 45 also has projections 60 which project outwardly beyond the edges 65 of the rear cover 5. The projections 60 are covered with a flexible covering 66. The combination of the projections 60 and the flexible coverings 66 is formed to be representative of limbs 68 of a selected character. As shown in FIG. 1, each of the limbs 68 represent an arm 25 and a hand 30, or a leg 35 and a foot 40 of the character, depending upon the shape and size of the covering 66 selected to cover each projection 60.

In a preferred embodiment, the frame 45 is formed from a flexible, thin metal wire which is easily contained within the thickness of the rear cover 5 and which may be repeatedly bent without failing. In alternate embodiments, the frame 45 is formed from flexible non-metallic material. The internal portions 50 of the frame 45 are secured within the rear cover 5 and are substantially immovable relative to the rear cover. The projections 60 and the flexible coverings 66 are bendable to a selected position relative to the rear cover 5 and allow the character represented to be posed. The projections 60 have a sufficient stiffness so the projections and the flexible coverings 66 will support the weight of the book 2 and remain in the selected position until being bent to another position. Accordingly, the limbs 68 of the selected character are movable to various positions relative to the rear and front covers 5 and 10. For example, the legs 35 and feet 40 may be positioned such that the book 2 will rest on the legs 35 and feet 40 in a vertical, "standing" position on a surface, such as a bookshelf Alternatively, the legs 35 may be bent at 90° to the rear cover 5 so as to "sit" the book 2 on the support surface. The arms 25 and hands 30 may be moved to a selected position, for example, to point to a portion of the rear or front covers 5 and 10 or to a particular page 20 within the book 2. Other positions for the limbs 68 are effectively limited only by the imagination of the user. In this manner, the book 2 is made interesting and entertaining to users, particularly youthful users, encouraging them to use the book and making reading the book more fun.

In a preferred embodiment, the coverings 66 on the projections 60 are in the form of a pliable rubber material which is sufficiently flexible to be bent with the respective projection into a myriad of desired positions or poses for the book 2. The coverings 66 are also sufficiently wear resistant to withstand repeated bending and handling by youthful users. Materials other than rubber, such as plastics or other elastomeric materials known to those skilled in the art, are used in alternate embodiments.

While the illustrated embodiments of the bound assembly 1 are reading books 1, the bound assembly of other embodiments include notebooks, date books, calendars, diaries, address books, coloring books, spiral or comb bound book assemblies, magazines, journals, notepads, and the like. In alternate embodiments, the frame 45 is connected to a backing of a structure, such as a picture frame of the like, with the bendable projections 60 extending outwardly from the edges of the backing.

As shown in FIG. 1, the projections 60 partially extend into the hands 30 and feet 40. In an alternate embodiment, the projections 60 extend through the entire length of one or both of the hands 30 and feet 40 and include further extensions which extend into individual fingers of the hand or individual toes of the foot, allowing those extremities to be separately bent and retained in selected positions.

Figure 2:
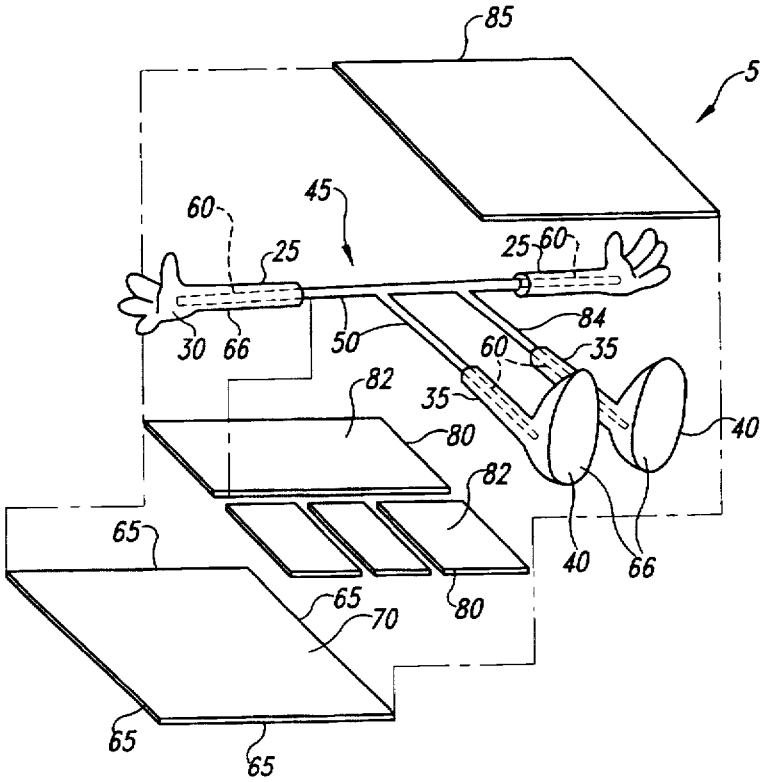
FIG. 2 is a reduced scale, exploded isometric view of the frame, flexible coverings, and rear cover of the book of FIG. 1.

FIG. 2 illustrates a preferred construction of the rear cover 5 of the book 2. The rear cover 5 includes a flat backing sheet 70 and the frame 45 is placed on the backing sheet such that upper surfaces 84 of the frame's internal portions 50 face away from the backing sheet, and the projections 60 extend beyond the edges of the backing sheet that define the edges 65 of the rear cover. The internal portions 50 of the frame 45 are bonded to the backing sheet 70. Spacer sheets 80 are adhered to the backing sheet 70 between the edges 65 and the internal portions 50 of the frame 45. The spacer sheets 80 are of such thickness that when placed upon the backing sheet 70, upper surfaces 82 of the spacer sheets are substantially flush with or project slightly above the upper surfaces 84 of the frame's internal portions 50. A cover sheet 85 is adhesively bonded to the upper surfaces 82 of the spacer sheets 80, so the spacer sheets and the frame's internal portions 50 are sandwiched between the cover sheet 85 and the backing sheet 70.

Once the adhesive binding the components of the rear cover 5 has cured, the projections 60 projecting from the edges 65 of the rear cover are movable to selected positions, as discussed above. The backing sheet 70, spacer sheets 80, and cover sheet 85 form a composite rear cover 5 which is sufficiently rigid to substantially prevent bending of the internal portions 50 of the frame 45 contained therein when the projections 60 are bent.

In alternate embodiments, the spacer sheets 80 are eliminated. In one such embodiment, the frame 45 creates a bulge in the rear cover 5 between the backing sheet 70 and the cover sheet 85. In another alternate embodiment, one or both of the backing sheet 70 and the cover sheet 85 are thick sheets of material, and channels are formed in one or both to accommodate the frame 45. The channels are sized to receive the frame's internal portions 50 when the backing sheet 70 and the cover sheet 85 are adhered together.

Although the frame 45 is discussed above as being adhered to the rear cover 5 of the book 2, in alternate embodiments, the frame is adhered to other portions of the book adapted to accommodate the frame, such as the front cover 10 or the top edge binding 15. In one alternate embodiment illustrated in FIG. 3, the frame's internal portions 50 are attached to an intermediate page 21 of the book 2 located part way between the rear and front covers 5 and 10. The intermediate page 21 has one edge adhered to the top edge binding 15. In a preferred aspect of the embodiment illustrated in FIG. 3, the intermediate page 21 to which the frame 45 is attached is reinforced to accommodate the frame and to allow the frame's projections 60 to move relative to the intermediate page while substantially preventing the internal portions 50 from moving. In one embodiment, the intermediate page 21 is reinforced using the construction method discussed above and shown in FIG. 2.

Figure 3:
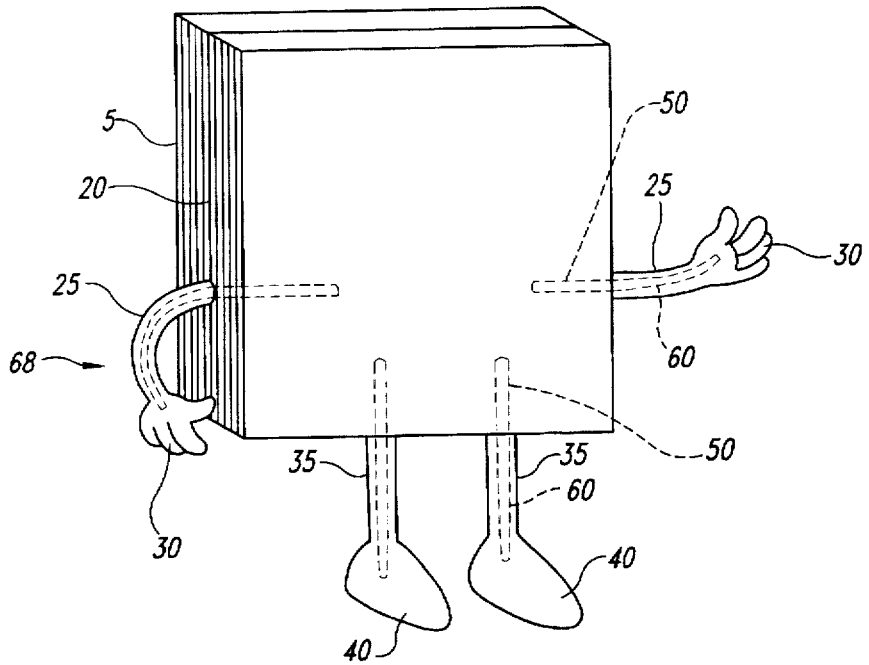
FIG. 3 is an isometric view of an alternate embodiment of the present invention in which a frame is attached to an internal page of a book.

In the alternate embodiment illustrated in FIG. 3, the frame 45 has a plurality of internal portions 50 which are not connected to each other. Each internal portion 50 is connected to one or more of the projections 60. The connection between the internal portions 50 and the intermediate page 21 are strong enough to prevent the internal portions from being easily detached from the page. In other alternate embodiments, the projections 60 and the internal portions 50 are joined by movable joints known to those skilled in the art, so movement of the projections does not exert a significant amount of force on the internal portions 50. In further alternate embodiments, the projections 60 are formed from a plurality of rigid, segmented sections which are joined together by movable joints known to those skilled in the art. In one such embodiment, the segmented sections correspond to the jointed limb sections of the human, animal or insect anatomy.

Figure 4:
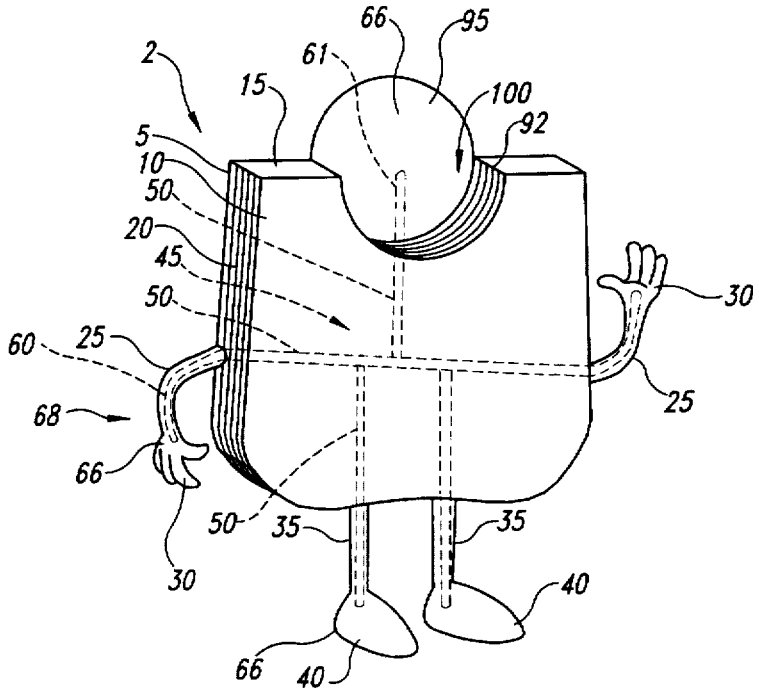
FIG. 4 is an isometric view of an alternate embodiment of the present invention in which covered frame projections projecting from a cover of a book represent the arms, legs, and head of a character.

As best seen in FIG. 4, an alternate embodiment of the book 2 has the frame 45 including an upper projection 61 projecting away from the legs 35. The upper projection 61 is covered with the same flexible covering 66 used for the limbs 68, but is sized and shaped to represent a head 95 of a selected character. The front cover 10 and pages 20 include a cutout 100 that is to accommodate the head 95 when the book 2 is opened and the pages are turned. In an alternate embodiment not shown, the upper projection 61 contained within the head 95 projects through and extends away from the top edge binding 15 such that the head 95 is positioned a selected distance away from and above the binding. In this embodiment, a cutout is no longer necessary to accommodate the head 95 and to allow the pages 20 to be turned. Although the head 95 is shown in FIG. 4 adjacent to the binding 15, and opposite the legs 35, in alternate embodiments, the head and limbs 68 have other orientations relative to each other, and limbs rather than the head may project from the binding.

The head 95 is similar in construction and flexibility to the arms 25, hands 30, legs 35, and feet 40 discussed above. The head 95 illustrated in FIG. 4 is positionable by the user to any of a myriad of locations to provide different poses for the character represented. The covering 66 which forms the head 95 is a flexible rubber or other suitable elastomeric material, which is sufficiently flexible to accommodate movement of the projection 60 contained therein to selected positions while remaining resilient enough to withstand repeated use by youthful users.

Figure 5:
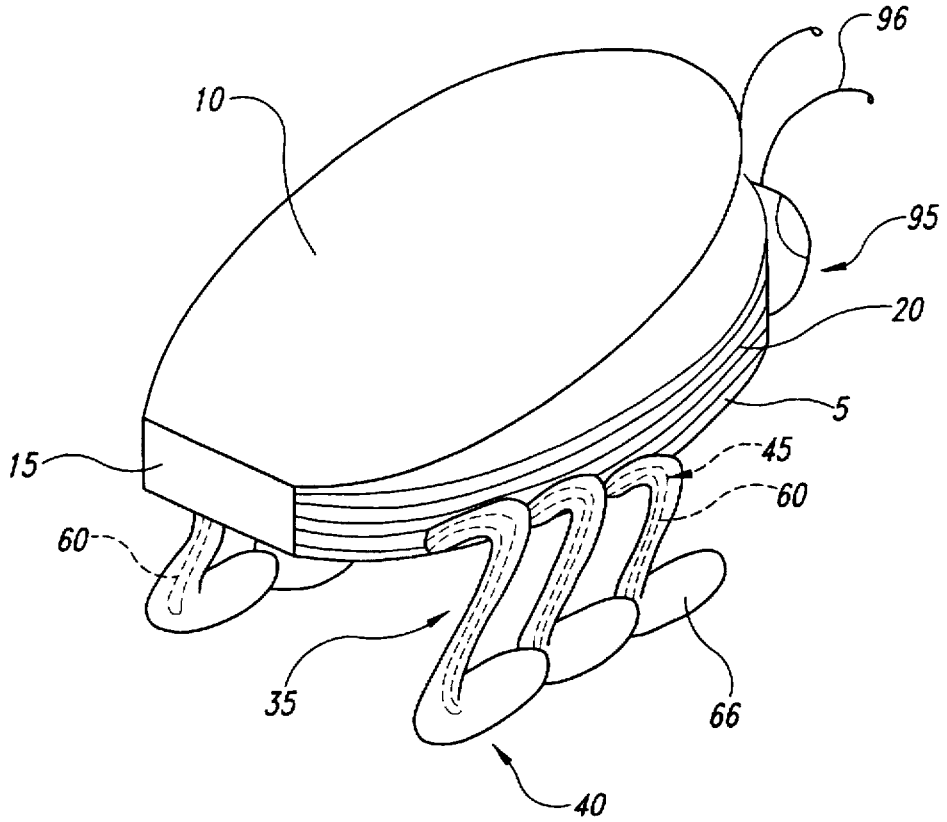
FIG. 5 is an isometric view of an alternate embodiment of the present invention in which covered frame projections projecting from a cover of a book represent the limbs, head and antennae of an insect.

The limbs 68 illustrated in FIGS. 1–4 are roughly representative of human appendages, although they may also be representative of animal or insect appendages. In an alternate embodiment illustrated in FIG. 5, the flexible coverings 66 and the frame 45 securely connected to the rear cover 5 are adapted to represent six legs 35 and six feet 40, a head 95, and a pair of antennae 96 of an insect. In other embodiments, other limbs, heads, antennae, and the like, may be used to represent any of the variety of known or imaginary animals or other objects. For example, the projections 60 of the frame 45 may be clad with coverings 66 representative of any number of mechanical components to simulate a robot or other machine. In a further alternate embodiment, the shapes of the limbs 68 and head 95 are representative of or relate to, the substantive contents of the book 2. For example, a book 2 about tigers includes limbs 68 and a head 95 representative of a tiger's limbs and head.

From the foregoing it will be appreciated that, although embodiments of the invention have been described herein for purposes of illustration, various modifications may be made without deviating from the spirit and scope of the invention. Accordingly, the invention is not limited except by the following claims.

I claim:

1. A bound assembly, comprising:

a cover;

a plurality of pages coupled to the cover; and a frame attached to one of the cover and a selected one of the pages, the frame having an interior portion contained within the one of the cover and the selected one of the pages, and the frame having at least one projecting portion attached to the interior portion and extending outwardly from an edge of the one of the cover and the selected one of the pages, the projecting portion being movable to a selected position relative to the cover and having a sufficient stiffness to remain in the selected position.

2. The bound assembly of claim 1 wherein the projecting portion has a flexible covering attached thereto.

3. The bound assembly of claim 1, further comprising a covering attached to the projecting portion, the covering having a shape representative of a body part.

4. The bound assembly of claim 3 wherein the covering is elastomeric.

5. The bound assembly of claim 1 wherein the frame is composed of a flexible metallic material.

6. The bound assembly of claim 5 wherein the cover has a front face and a rear face, and the interior portion of the frame is positioned between the front and rear faces.

7. The bound assembly of claim 1 wherein the projecting portion is bendable relative to the cover and has a sufficient stiffness to allow the projecting portion to be bent to a selected bent position and remain in the selected bent position after being moved thereto.

8. The bound assembly of claim 1 wherein the cover includes a first cover and a binding, the plurality of pages being attached to the binding of the first cover, further comprising a second cover attached to the binding.

9. The bound assembly of claim 1 wherein the cover includes a first cover, a second cover and a binding joining the first and second covers, the projecting portion projecting through the binding.

10. The bound assembly of claim 1 wherein the projecting portion has an engagement portion to engage a support surface and the projecting portion supports the bound assembly relative to the support surface, the projecting portion being sufficiently rigid to support the weight of the bound assembly.

11. The bound assembly of claim 1 wherein the projecting portion is a first projecting portion, and the frame includes a second projecting portion extending outwardly from the cover.

12. A bound assembly, comprising:

cover members including a first cover, a second cover attached to the first cover with a binding and being movable relative to the first cover, and a plurality of pages positioned between the first and second covers and attached to one of the cover members; and a frame attached to one of the cover members, the frame having at least one projecting portion projecting outwardly from an edge of the one of the cover members, the projecting portion being movable to a selected position relative to one of the cover members and having a sufficient stiffness to remain in the selected position.

13. The bound assembly of claim 12 wherein the frame has a flexible covering attached to the projecting portion of the frame.

14. The bound assembly of claim 12, further comprising a covering attached to the projecting portion of the frame and having a shape representative of a body part.

15. The bound assembly of claim 12, further comprising a covering attached to the projecting portion of the frame and having a representative shape selected from the group consisting of a hand, foot, arm, leg, head, or antenna.

16. A cover assembly of the type usable with a bound assembly, comprising:

a cover member; and a frame having an attachment portion attached to the cover member and a projecting portion connected to the attachment portion and projecting outwardly from an edge of the cover member, the projecting portion being movable to a selected position relative to the cover member and the attachment portion and having a sufficient stiffness to remain in the selected position.

17. The cover assembly of claim 16 wherein the cover member has a first sheet and a second sheet, the second sheet coupled to the first sheet, the attachment portion of the frame being attached between the first and second sheets.

18. The cover assembly of claim 17, further comprising a spacer sheet positioned between the first and second sheets and adjacent to the attachment portion of the frame.

19. The cover assembly of claim 16 wherein the frame has a covering attached to the projecting portion of the frame.

20. The cover assembly of claim 16, further comprising a frame covering attached to the projecting portion of the frame and having a shape representative of a body part.

21. A posable book, comprising:

a cover;

a frame attached to the cover, the frame having an internal portion within the cover and a pair of projecting portions connected to the internal portion and extending outwardly from at least one edge of the cover, the projecting portions being bendable to a selected position relative to the cover, at least one of the projecting portions having an engagement portion to engage a support surface and the projecting portion supports the book relative to the support surface, the projecting portion being sufficiently rigid to support the weight of the book, and having a sufficient stiffness to remain in a selected position; and a plurality of pages coupled to the cover.

22. The posable book of claim 21 wherein each of the projection portions have a flexible covering thereon.

23. The posable book of claim 22 wherein the flexible coverings are shaped to represent an appendage of one of a human, animal, insect, or mechanical structure.

24. The posable book of claim 22 wherein the flexible covering defines the engagement portion of the projection portions.

25. The posable book of claim 21 wherein the cover has front and back sheets connected together and the internal portion of the frame is sandwiched between the front and back sheets.

26. The posable book of claim 25 wherein the cover has a spacer sheet positioned between the front and back sheets adjacent to the internal portion of the frame.

27. The posable book of claim 21 wherein the internal portion of the frame is a first internal portion and the pair of projecting portions include first and second projecting portions, the frame having a second internal portion and a third projecting portion integrally connected to the second internal portion.

28. The posable book of claim 27 wherein the first and second internal portions are separate portions out of engagement with each other.

* * * * *